US010524327B2

(12) United States Patent
Udavant et al.

(10) Patent No.: US 10,524,327 B2
(45) Date of Patent: Dec. 31, 2019

(54) RANGE-ADJUSTABLE WALLBOX CONTROLLERS FOR ELECTRICAL DEVICES

(71) Applicant: Eaton Intelligent Power Limited, Dublin (IE)

(72) Inventors: Rohit Madhav Udavant, Decatur, GA (US); Vaske Mikani, Senoia, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/142,434

(22) Filed: Sep. 26, 2018

(65) Prior Publication Data

US 2019/0098721 A1 Mar. 28, 2019

Related U.S. Application Data

(60) Provisional application No. 62/563,248, filed on Sep. 26, 2017.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0863* (2013.01); *H05B 33/0845* (2013.01); *H05B 37/0227* (2013.01); *H05B 37/0245* (2013.01); *H05B 37/0272* (2013.01)

(58) Field of Classification Search
None
See application file for complete search history.

(56) References Cited

U.S. PATENT DOCUMENTS

| | | | | |
|---|---|---|---|---|
| 9,916,946 | B1 * | 3/2018 | Mathew | H01H 15/02 |
| 2013/0010018 | A1 * | 1/2013 | Economy | H04W 76/10 345/691 |
| 2016/0036349 | A1 * | 2/2016 | Steiner | H02M 7/217 315/307 |
| 2016/0338167 | A1 * | 11/2016 | Steiner | H05B 33/0854 |
| 2017/0374718 | A1 * | 12/2017 | Fang | H05B 37/0272 |
| 2018/0368237 | A1 * | 12/2018 | Gal | H05B 37/0227 |

* cited by examiner

*Primary Examiner* — Anh Q Tran
(74) *Attorney, Agent, or Firm* — King & Spalding LLP

(57) ABSTRACT

A wallbox controller for controlling a parameter of an electrical device can include a selector circuit that controls a value of the parameter within a range of values. The wallbox controller can also include a first range limit setting interface coupled to the selector circuit, where the first range limit setting interface sets a first limit for the range of values.

17 Claims, 7 Drawing Sheets

600

RANGE-ADJUSTABLE WALLBOX CONTROLLERS FOR ELECTRICAL DEVICES

CROSS REFERENCE TO RELATED APPLICATIONS

This application claims priority under 35 U.S.C. § 119 to U.S. Provisional Patent Application Ser. No. 62/563,248, titled "Wallbox Controllers For Light Fixtures" and filed on Sep. 26, 2017, the entire contents of which are hereby incorporated herein by reference.

TECHNICAL FIELD

Embodiments of the invention relate generally to electrical device (e.g., light fixture) control, and more particularly to systems, methods, and devices for range-adjustable wallbox controllers for electrical devices.

BACKGROUND

Some light fixtures are dimmable, which allows a user to adjust the amount of light that is output by the light sources of the light fixture. In such a case, the dimming capabilities are relatively rudimentary. Some light fixtures also can allow for a user to adjust correlated color temperature (CCT). The CCT control for light fixtures is also currently somewhat rudimentary. Similarly, other electrical devices can be similarly controlled.

SUMMARY

In general, in one aspect, the disclosure relates to a wallbox controller for controlling a parameter of an electrical device. The wall box controller can include a selector circuit that controls a value of the parameter within a range of values. The wall box controller can also include a first range limit setting interface coupled to the selector circuit, wherein the first range limit setting interface sets a first limit for the range of values.

These and other aspects, objects, features, and embodiments will be apparent from the following description and the appended claims.

BRIEF DESCRIPTION OF THE DRAWINGS

The drawings illustrate only example embodiments of range-adjustable wallbox controllers for electrical devices and are therefore not to be considered limiting of its scope, as range-adjustable wallbox controllers for electrical devices may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
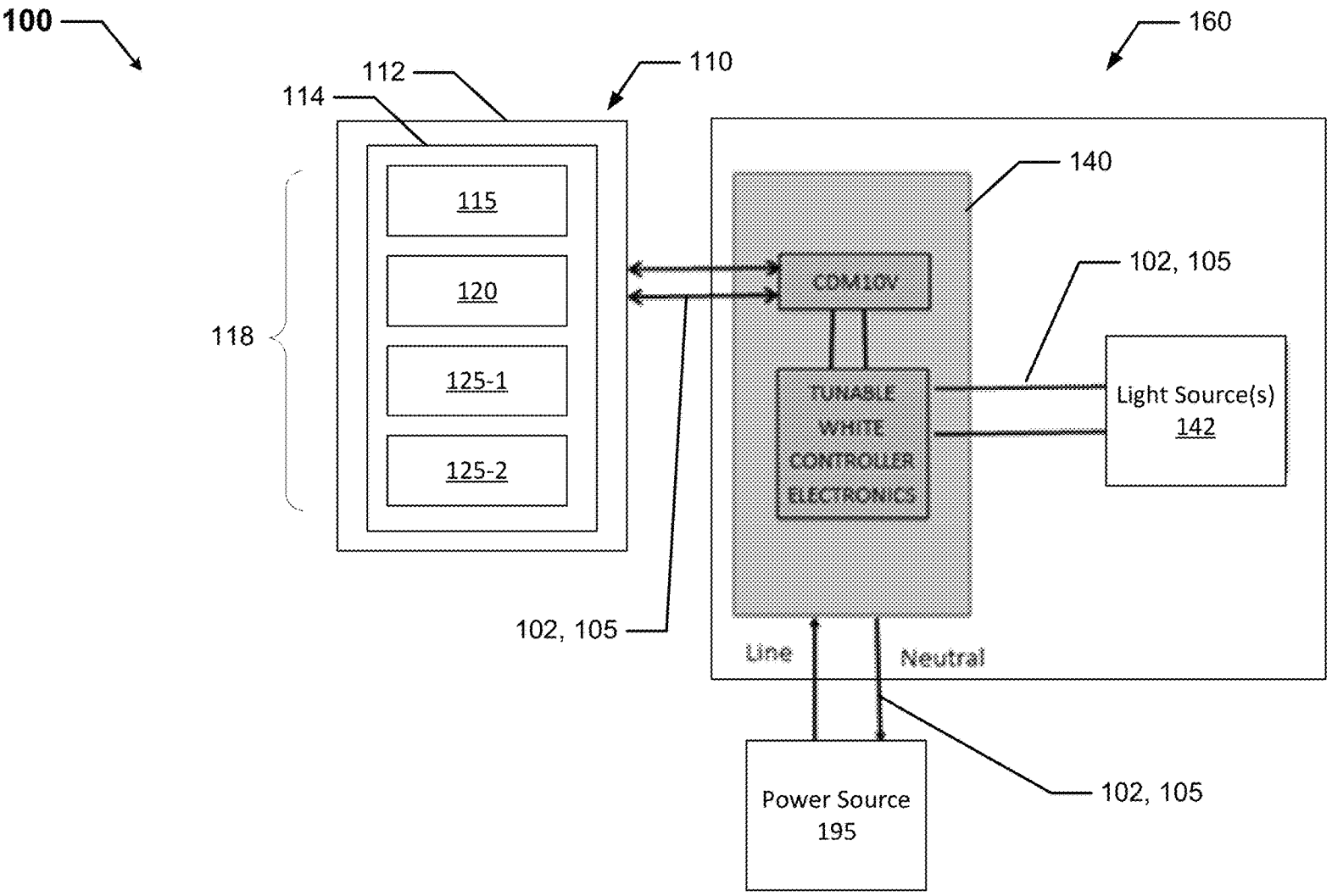
FIG. 1 shows a block diagram of a lighting system that includes an example range-adjustable wallbox controller in accordance with certain example embodiments.

The example embodiments discussed herein are directed to systems, methods, and devices for range-adjustable wallbox controllers for electrical devices. While example embodiments of range-adjustable wallbox controllers are described herein as being used with light fixtures, such range-adjustable wallbox controllers can alternatively be used with any of a number of other electrical devices (or components thereof), including but not limited to sensors, speakers, monitors, televisions, and digital displays.

Example embodiments can be used with light fixtures or other electrical devices located in any of a number of different environments (e.g., indoor, outdoor, hazardous, non-hazardous, high humidity, low temperature, corrosive, sterile, high vibration). Further, when the electrical device is a light fixture, such light fixture described herein can use one or more of a number of different types of light sources, including but not limited to light-emitting diode (LED) light sources, organic LEDs, fluorescent light sources, incandescent light sources, and halogen light sources. Therefore, light fixtures described herein, even in hazardous locations, should not be considered limited to a particular type of light source. When a light fixture uses LED light sources, those LED light sources can include any type of LED technology, including, but not limited to, chip on board (COB) and discrete die. Example range-adjustable wallbox controllers (including components thereof) described herein can be made of one or more of a number of materials, including but not limited to plastic, copper, aluminum, rubber, stainless steel, and ceramic.

In certain example embodiments, electrical devices, including example range-adjustable wallbox controllers, are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures. Use of example embodiments described herein meet (and/or allow a corresponding device to meet) such standards when required.

Any components of example range-adjustable wallbox controllers described herein can be made from a single piece (e.g., as from a mold, injection mold, die cast, 3-D printing process, extrusion process, stamping process, or other prototype methods). In addition, or in the alternative, components of example range-adjustable wallbox controllers can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of an example range-adjustable wallbox controller to become coupled, directly or indirectly, to another portion of the range-adjustable wallbox controller and/or other component (e.g., a wall, a stud) of a system. A coupling feature can include, but is not limited to, a snap, a clamp, a portion of a hinge, an aperture, a recessed area, a protrusion, a slot, a spring clip, a tab, a detent, and mating threads. One portion of an example range-adjustable wallbox controller can be coupled to another component of the range-adjustable wallbox controller or other component of a system by the direct use of one or more coupling features.

In addition, or in the alternative, a portion of an example range-adjustable wallbox controller can be coupled to another component of the range-adjustable wallbox controller or other component of a system using one or more independent devices that interact with one or more coupling features disposed on a component of the range-adjustable wallbox controller. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of range-adjustable wallbox controllers for electrical devices will be described more fully hereinafter with reference to the accompanying drawings, in which example embodiments of range-adjustable wallbox controllers for electrical devices are shown. Range-adjustable wallbox controllers for electrical devices may, however, be embodied in many different forms and should not be construed as limited to the example embodiments set forth herein. Rather, these example embodiments are provided so that this disclosure will be thorough and complete, and will fully convey the scope of range-adjustable wallbox controllers for electrical devices to those or ordinary skill in the art. Like, but not necessarily the same, elements (also sometimes called components) in the various figures are denoted by like reference numerals for consistency.

Terms such as "first", "second", "top", "bottom", "side", "front", "distal", "proximal", and "within" are used merely to distinguish one component (or part of a component or state of a component) from another. Such terms are not meant to denote a preference or a particular orientation, and are not meant to limit embodiments of range-adjustable wallbox controllers for electrical devices. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a block diagram of a lighting system 100 (a type of electrical system) that includes an example electrical devices wallbox control device 110 in accordance with certain example embodiments. In addition to the electrical devices wallbox control device 110, the lighting system 100 of FIG. 1 includes a light fixture 160 (a type of electrical device) that is coupled to the electrical devices wallbox control device 110 and to a power source 195 using one or more electrical conductors 102 and/or wireless links 105, both of which are described below with respect to FIGS. 6A and 6B. The light fixture 160 of FIG. 1 includes a power supply 140 and one or more light sources 142 that are coupled to each other using one or more electrical conductors 102 and/or wireless links 105.

The power source 195 of the lighting system 100 provides AC mains or some other form of power to the light fixture 160. The power source 195 can include one or more of a number of components. Examples of such components can include, but are not limited to, an electrical conductor, a coupling feature (e.g., an electrical connector), a transformer, an inductor, a resistor, a capacitor, a diode, a transistor, and a fuse. The power source 195 can be, or include, for example, a wall outlet, an energy storage device (e.g. a battery, a supercapacitor), a circuit breaker, and/or an independent source of generation (e.g., a photovoltaic solar generation system).

The power source 195 can be coupled to the power supply 140 of the light fixture 160. In this case, the power source 195 includes one or more electrical conductors 102, at the distal end of which can be disposed a coupling feature (e.g., an electrical connector). The power supply 140 of the light fixture 160 can also include one or more electrical conductors 102 that complement and couple to the electrical conductors 102 of the power source 195. In this way, the AC mains provided by the power source 195 is delivered directly to the power supply 140 of the light fixture 160.

The power supply 140 of the light fixture 160 receives power (e.g., AC mains power) from the power source 195. The power supply 140 uses the power it receives to generate and provide power to the light sources 142. The power supply 140 can be called by any of a number of other names, including but not limited to a driver, a LED driver, and a ballast. The power supply 140 can include one or more of a number of single or multiple discrete components (e.g., transistor, diode, resistor), and/or a microprocessor. The power supply 140 may include a printed circuit board, upon which the microprocessor and/or one or more discrete components can be positioned.

In some cases, the power supply 140 can include one or more components (e.g., a transformer, a diode bridge, an inverter, a converter) that receives power from the power source 195 and generates power of a type (e.g., alternating current, direct current) and level (e.g., 12V, 24V, 120V) that can be used by the light sources 142. In addition, or in the alternative, the power supply 140 can be a source of power in itself. For example, the power supply 140 can be or include a battery, a localized photovoltaic solar power system, or some other source of independent power.

The light sources 142 emit light using power provided by the power supply 140. The light fixture 160 can have one or more of any number and/or type (e.g., light-emitting diode (LED), incandescent, fluorescent, halogen) of light sources 142. A light source 142 can vary in the amount and/or color of light that it emits. As discussed above, when a light fixture 160 uses LED light sources 142, those LED light sources 142 can include any type of LED technology, including, but not limited to, chip on board (COB) and discrete die.

The example wallbox control device 110 can be defined, at least in part, by a housing 112. The housing can include at least one wall that forms a cavity, inside of which can be disposed one or more of a number of components of the wallbox control device 110. Such components of the wallbox control device 110 can vary. For example, as shown in FIG. 1, the wallbox control device 110 can include a current sinking circuit 115, a selector circuit 120, a range limit setting interface 125-1, and a range limit setting interface 125-2. Some or all of these circuits can be disposed on a circuit board 114 within a housing 112. All of the various circuits of the wallbox control device 110 can be referred to as a wallbox controller circuit 118. An example of a wallbox controller circuit 118 is shown below with respect to FIG. 4.

Figure 2:
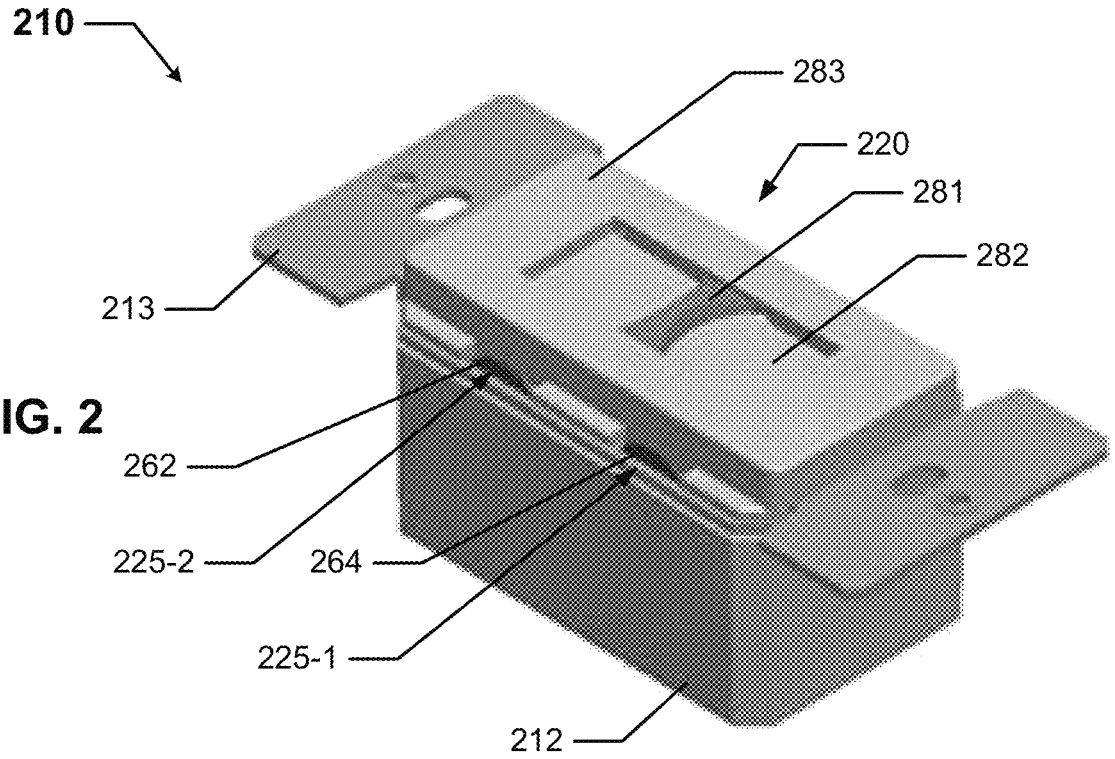
FIG. 2 shows a range-adjustable wallbox controller for providing dimming control in accordance with certain example embodiments.
Figure 3:
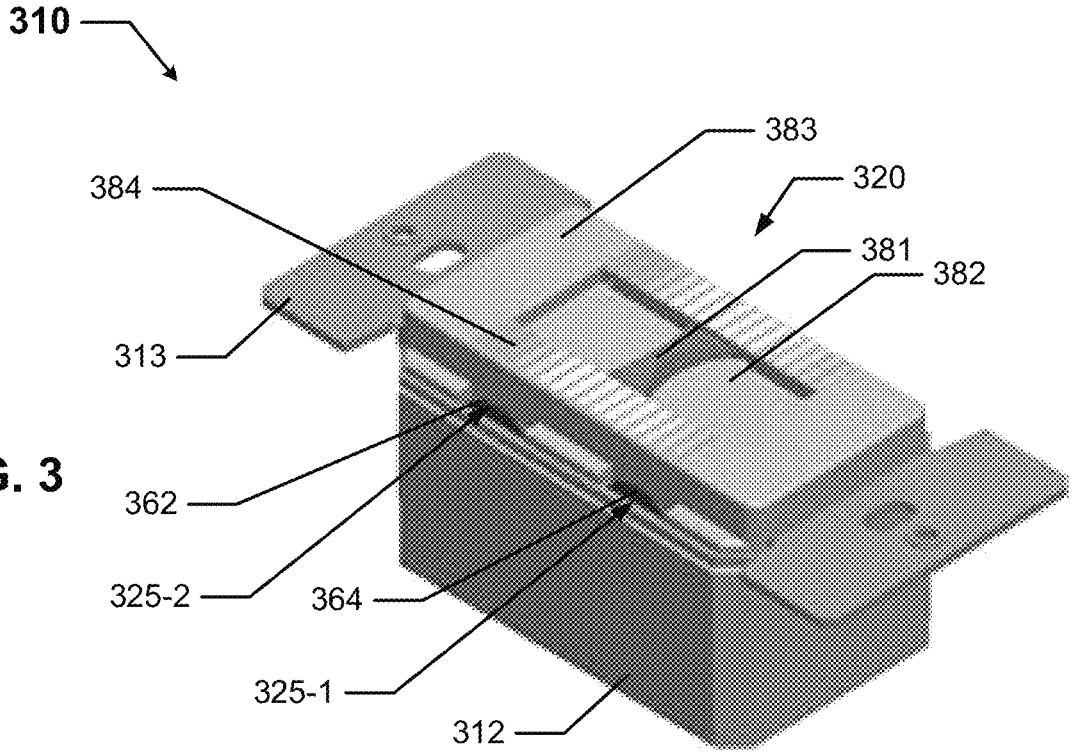
FIG. 3 shows another range-adjustable wallbox controller for providing CCT control in accordance with certain example embodiments.
Figure 4:
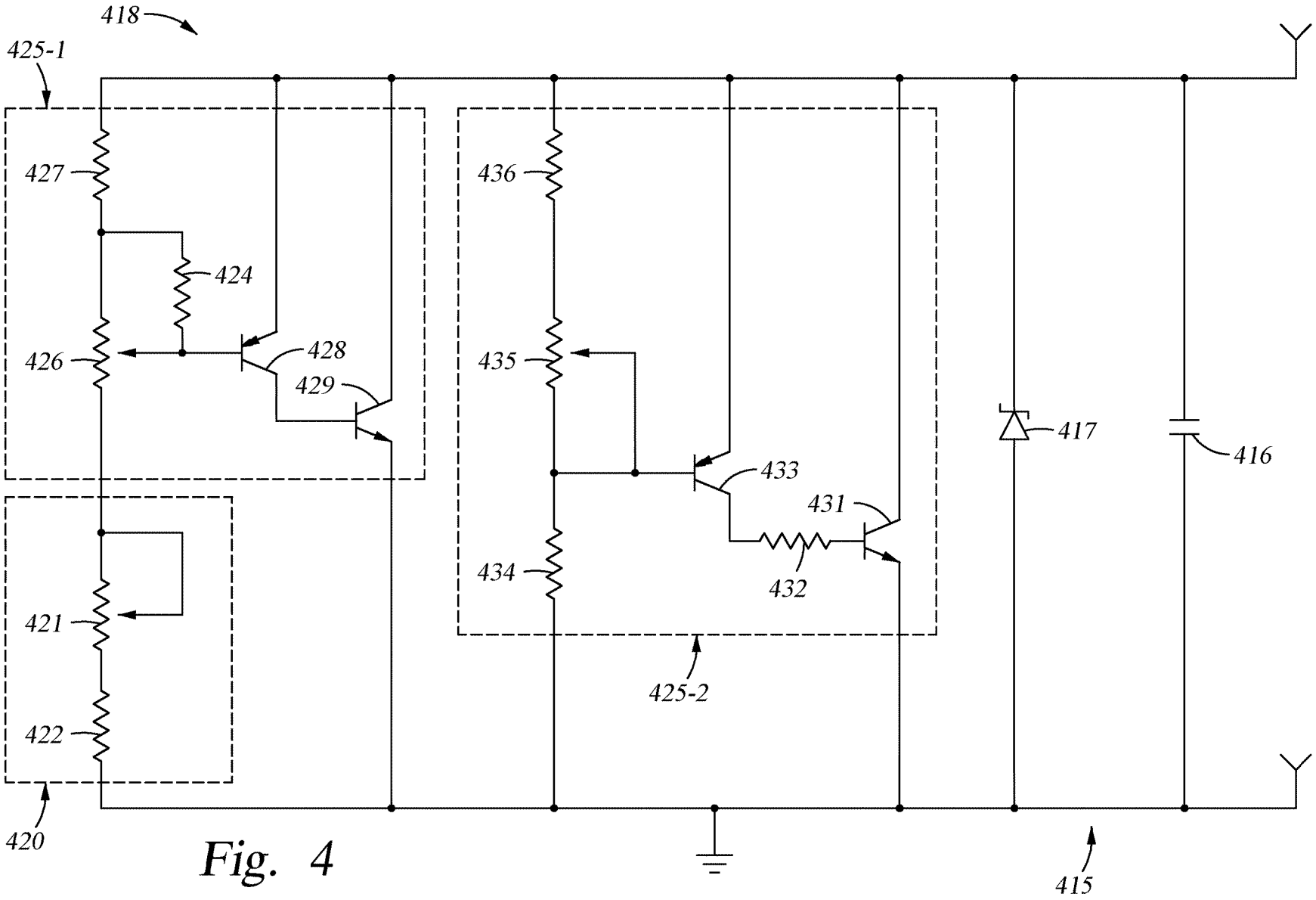
FIG. 4 shows a circuit diagram of a range-adjustable wallbox controller circuit in accordance with certain example embodiments.

In certain example embodiments, the selector circuit 120 is coupled to a slider (as shown in FIGS. 2 and 3 below) or some other form of user interface (e.g., a dial, a paddle, a touch screen) on the wallbox control device 110. While the user interface is accessible to a user when the wallbox control device 110 is installed, the corresponding selector circuit 120 is inaccessible to a user unless the wallbox control device 110 is uninstalled and disassembled. As the user interface (and so also the corresponding selector control 120) is adjusted, it alters a parameter (e.g., CCT, intensity) of the light emitted by the light sources 142. The selector circuit 120 can move within a range that is bounded (limited) by the settings of the range limit setting interface 125-1 and the range limit setting interface 125-2. The selector circuit 120 can include one or more of a number of components. For example, the selector circuit 120 can include a potentiometer or other form of variable resistor and a resistor with a fixed resistance. An example of a selector circuit 120 is shown in FIG. 4 below.

The range limit setting interface 125-1 (also called, among other names, the upper trim pot) is a user-adjustable circuit that allows the user to set an upper limit of the parameter (e.g., CCT, intensity) of the light emitted by the light sources 142 that is controlled using the example wallbox control device 110. The range limit setting interface 125-1 can be a component that is physically manipulated by a user and/or a component that is manipulated virtually (e.g., through an app, by particular motions). In certain example embodiments, the range limit setting interface 125-1 is only accessible when the wallbox control device 110 is uninstalled and disassembled. The range limit setting interface 125-1 can include one or more of a number of components. For example, the range limit setting interface 125-1 can include a potentiometer or other form of variable resistor, a transistor, and a resistor with a fixed resistance. An example of an range limit setting interface 125-1 that is a component that is physically manipulated by a user is shown in FIG. 4 below. An example of an range limit setting interface 125-1 that is a component that is not physically manipulated by a user is shown in FIG. 6 below.

The range limit setting interface 125-2 (also called, among other names, the lower trim pot) is a user-adjustable circuit that allows the user to set a lower limit of the parameter (e.g., CCT, intensity) of the light emitted by the light sources 142 that is controlled using the example wallbox control device 110. In certain example embodiments, the range limit setting interface 125-2 is only accessible when the wallbox control device 110 is uninstalled and disassembled. The range limit setting interface 125-2 can include one or more of a number of components. For example, the range limit setting interface 125-2 can include a potentiometer or other form of variable resistor, a transistor, and a resistor with a fixed resistance. An example of a range limit setting interface 125-2 is shown in FIG. 4 below.

The current sinking circuit 115 is a circuit that receives a signal (0V-10V) from the power supply 142, sends the signal through the remainder (e.g., the selector circuit 120, the range limit setting interface 125-1, the range limit setting interface 125-2) of the wallbox controller circuit 118, and returns the signal, as altered based on the settings of the selector circuit 120, the range limit setting interface 125-1, and the range limit setting interface 125-2, to the power supply 140. The current sinking circuit 115 can include one or more of a number of components. For example, the range limit setting interface 125-2 can include a diode and a capacitor. An example of a current sinking circuit 115 is shown in FIG. 4 below.

In certain example embodiments, the wallbox control device 110 does not include an "on/off" switch. In other words, the wallbox control device 110 only allows a user to adjust a parameter (e.g., CCT, intensity) of the light emitted by the light sources 142 within a range of values, as determined by the settings of the range limit setting interface 125-1 and the range limit setting interface 125-2. Similarly, no part of the wallbox controller circuit 118 includes an "on/off" switch in certain example embodiments.

FIG. 2 shows a wallbox control device 210 for providing dimming control in accordance with certain example embodiments. Intensity dimmers, such as the example wallbox control device 210 of FIG. 2, are used to vary the intensity of light output by the light sources (e.g., light sources 142) of 0V-10V dimmable light fixtures (e.g., light fixture 160). Since certain example wallbox controllers 210 do not provide or include a separate ON/OFF switch, as discussed above, the wallbox control device 210 can be used in conjunction with a momentary or other switch. If there exists an arrangement having a sensor and relay switch-pack, then the sensor can automatically control the switching of load, or the user can turn the lights ON/OFF using a momentary switch. In such a case, the wallbox control device 210 can control the dimming function of a light fixture.

Referring to FIGS. 1 and 2, the wallbox control device 210 of FIG. 2 includes a number of components. For example, the wallbox control device 210 can include a cover, a faceplate 283, a strap 213, an enclosure 212, and wallbox controller circuit (e.g., wallbox controller circuit 118) disposed within a cavity formed by the enclosure 212. The cover in this case is removed and not shown in FIG. 2.

The wallbox control device 210 of FIG. 2 can also include one or more of a number of selector circuits 220 and/or one or more of a number of range limit setting interfaces 225. In this case, there is one selector circuit 220 and two range limit setting interfaces 225. The selector circuit 220 includes a user interface that includes a selector 281 that moves within a slidebar 282 on the front surface of the faceplate 283. The slidebar 282 and the selector 281 can be fully accessible when the cover is coupled to the rest of the wallbox control device 210 and also when the wallbox control device 210 is installed.

The first range limit setting interface 225-1 of the wallbox control device 210 of FIG. 2 is a dial 264. In certain example embodiments, the dial 264 is only accessible to a user when the cover is removed. The dial 264 can be directly coupled to, or can be part of, a potentiometer or other form of variable resistor of the range limit setting interface 225-1 of the wallbox control device 210. In this way, when the dial 264 is adjusted, the upper limit of the slidebar 282 of the selector circuit 220 is also adjusted.

For example, since the intensity dimming is achieved by regulating the voltage fed to the light fixture (e.g., light fixture 160), the dial 264 can be used to allow a user to adjust the upper limit of the voltage range (e.g., between 5V and 9V). If the dial 264 is moved to a position that sets the upper limit of the voltage range (in other words, the range limit setting interface 225-1) to 8V in a 0V-10V light fixture, then upper limit of the slidebar 282 of the selector circuit 220 is 80% of the full intensity of the light sources 142.

The range limit setting interface 225-2 of the wallbox control device 210 of FIG. 2 is a dial 262, which can be substantially the same as or different than the dial 264. In certain example embodiments, the dial 262 is only accessible to a user when the cover is removed. The dial 262 can be directly coupled to, or can be part of, a potentiometer or other form of variable resistor of the range limit setting interface 225-2 of the wallbox control device 210. In this way, when the dial 262 is adjusted, the lower limit of the slidebar 282 of the user interface 220 is also adjusted.

For example, since the intensity dimming is achieved by regulating the voltage fed to the light fixture (e.g., light fixture 160), the dial 262 can be used to allow a user to adjust the lower limit of the voltage range (e.g., between 1V and 4V). If the dial 262 is moved to a position that sets the lower limit of the voltage range (in other words, the range limit setting interface 225-2) to 4V in a 0V-10V light fixture, then lower limit of the slidebar 282 of the selector circuit 220 is 40% of the full intensity of the light sources 142.

FIG. 3 shows another wallbox control device 310 for providing CCT control in accordance with certain example embodiments. Referring to FIGS. 1-3, the wallbox control device 310 of FIG. 3 includes a number of components. For example, the wallbox control device 310 can include a cover, a faceplate 383, a strap 313, an enclosure 312, and wallbox controller circuit (e.g., wallbox controller circuit 118) disposed within a cavity formed by the enclosure 212. The cover in this case is removed and not shown in FIG. 3. Also, in this case, a scale 384 is disposed on the faceplate 383 adjacent to the selector circuit 320, described below.

The wallbox control device 310 of FIG. 3 can also include one or more of a number of interfaces. In this case, there is one selector circuit 320 and two range limit setting interfaces 325. The selector circuit 320 includes a user interface that includes a selector 381 that moves within a slidebar 382 on the front surface of the faceplate 383. The slidebar 382 and the selector 381 can be fully accessible when the cover is coupled to the rest of the wallbox control device 310 and also when the wallbox control device 310 is installed.

The first range limit setting interface 325-1 of the wallbox control device 310 of FIG. 3 is a dial 364. In certain example embodiments, the dial 364 is only accessible to a user when the cover is removed. The dial 364 can be directly coupled to, or can be part of, a potentiometer or other form of variable resistor of the range limit setting interface 325-1 of the wallbox control device 310. In this way, when the dial 364 is adjusted, the upper limit of the slidebar 382 of the selector circuit 320 is also adjusted.

For example, since the CCT is achieved by regulating the voltage fed to the light fixture (e.g., light fixture 160), the dial 364 can be used to allow a user to adjust the upper limit of the voltage range (e.g., between 5V and 9V). If the dial 364 is moved to a position that sets the upper limit of the voltage range (in other words, the range limit setting interface 6325-1) to 7V in a 0V-10V light fixture, then upper limit of the slidebar 382 of the selector circuit 320 is a CCT associated with 70% of the full scale of the light sources 142.

The second range limit setting interface 325-2 of the wallbox control device 310 of FIG. 3 is a dial 362, which can be substantially the same as or different than the dial 364. In certain example embodiments, the dial 362 is only accessible to a user when the cover is removed. The dial 362 can be directly coupled to, or can be part of, a potentiometer or other form of variable resistor of the range limit setting interface 325-2 of the wallbox control device 210. In this way, when the dial 362 is adjusted, the lower limit of the slidebar 382 of the selector circuit 320 is also adjusted.

For example, since the CCT is achieved by regulating the voltage fed to the light fixture (e.g., light fixture 160), the dial 362 can be used to allow a user to adjust the lower limit of the voltage range (e.g., between 1V and 4V). If the dial 362 is moved to a position that sets the lower limit of the voltage range (in other words, the range limit setting interface 325-2) to 2V in a 0V-10V light fixture, then lower limit of the slidebar 382 of the selector circuit 320 is 20% of the full intensity of the light sources 142.

FIG. 4 shows a circuit diagram of a wallbox controller circuit 418 in accordance with certain example embodiments. Referring to FIGS. 1-4, the wallbox controller circuit 418 includes a current sinking circuit 415, a selector circuit 420, a first range limit setting interface 425-1, and a second range limit setting interface 425-2. Each circuit can include one or more of a number of various components. In certain example embodiments, a hardware processor is not included among the components of the wallbox controller circuit 418, which allows the wallbox controller circuit 418 to operate without (or with very minimal (e.g., less than 0.7V)) power. The current sinking circuit 415 of FIG. 4 includes a Zener diode 417 and a capacitor 416 connected in parallel with each other and with the rest of the wallbox controller circuit 418.

The selector circuit 420 of FIG. 4 includes a fixed-value resistor 422 and a potentiometer 421. As discussed above, the potentiometer 421 of the selector circuit 420 can be driven by the position of the selector (e.g., selector 281, selector 381) of the selector circuit 420. In addition, the voltage equivalent of the upper and lower bounds (limits) of the potentiometer 421 are determined by the range limit setting interface 425-1 and the lower setting circuit 425-2, respectively.

The range limit setting interface 425-1 of FIG. 4 includes a fixed-value resistor 424, a fixed-value resistor 427, a potentiometer 426, a transistor 428 (e.g., a bipolar junction transistor), and a transistor 429. As discussed above, the potentiometer 426 of the range limit setting interface 425-1 can be driven by the position of a selector (e.g., selector 264, selector 364) of the range limit setting interface 425-1. In addition, the upper bound (limit) of the slidebar (e.g., slidebar 282, slidebar 382) of the associated user interface 420 is determined by the position of the potentiometer 426 of the range limit setting interface 425-1.

The range limit setting interface 425-2 of FIG. 4 includes a fixed-value resistor 432, a fixed-value resistor 436, a potentiometer 435, a transistor 431 (e.g., a bipolar junction transistor), and a transistor 433. As discussed above, the potentiometer 435 of the range limit setting interface 425-2 can be driven by the position of a selector (e.g., selector 262, selector 362) of the range limit setting interface 425-2. In addition, the lower bound (limit) of the slidebar (e.g., slidebar 282, slidebar 382) of the associated user interface 420 is determined by the position of the potentiometer 426 of the range limit setting interface 425-2.

Figure 5:
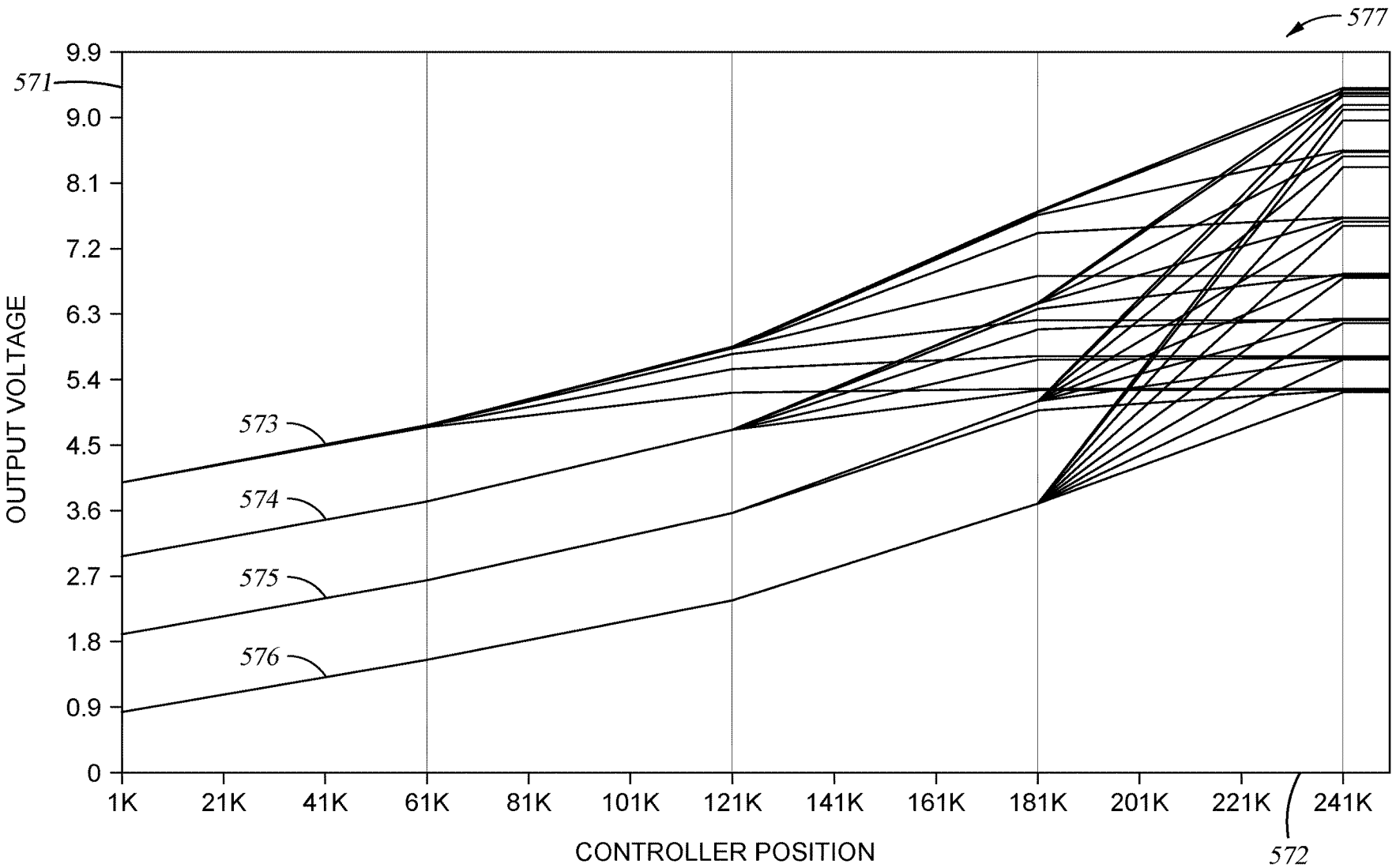
FIG. 5 shows a graph of output voltage relative to controller position in accordance with certain example embodiments.

FIG. 5 shows a graph 577 of output voltage 571 relative to controller position 572 in accordance with certain example embodiments. Referring to FIGS. 1-5, the controller position 572 is with respect to a position of the selector (e.g., selector 281, selector 381) along a slidebar (e.g., slidebar 282, slidebar 382) of a user interface (e.g., selector circuit 220, selector circuit 320). Plot 573 shows the output voltage when the lower setting circuit 430 sets the minimum voltage in the range at approximately 4.0V. The range limit setting interface 425 for plot 573 can vary, setting the maximum voltage in the range to be between approximately 5.0V and approximately 9.5V.

Plot 574 shows the output voltage when the range limit setting interface 425-2 sets the minimum voltage in the range at approximately 3.0V. The range limit setting interface 425-1 for plot 574 can vary, setting the maximum voltage in the range to be between approximately 5.0V and approximately 9.5V, Plot 575 shows the output voltage when the range limit setting interface 425-2 sets the minimum voltage in the range at approximately 1.9V. The range limit setting interface 425-1 for plot 575 can vary, setting the maximum voltage in the range to be between approximately 5.0V and approximately 9.5V.

Plot 576 shows the output voltage when the range limit setting interface 425-2 sets the minimum voltage in the range at approximately 0.8V. The range limit setting interface 425-1 for plot 576 can vary, setting the maximum voltage in the range to be between approximately 5.0V and approximately 9.5V.

Figure 6A:
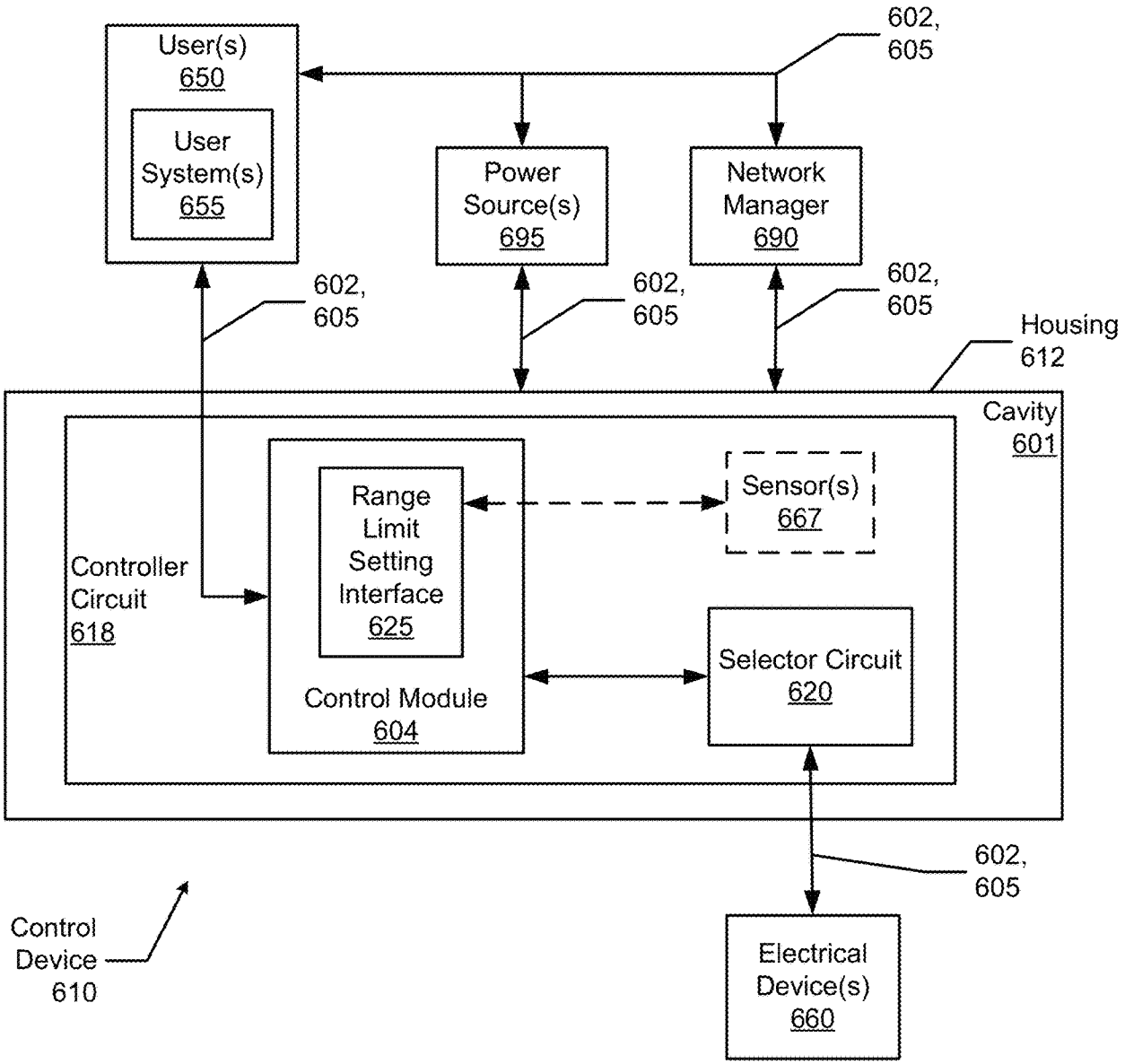
FIGS. 6A and 6B show diagrams of a system that includes a controller in accordance with certain example embodiments.
Figure 6B:
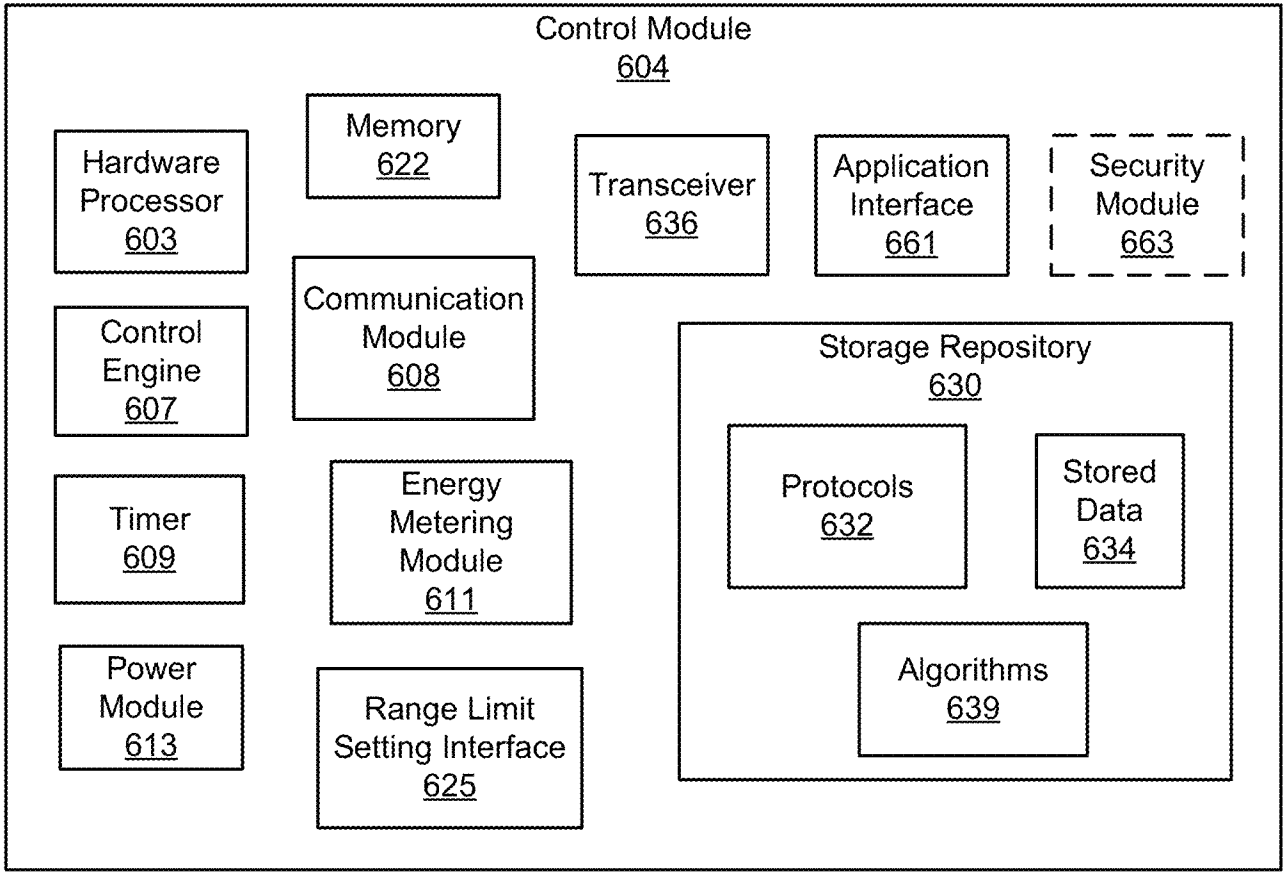
Figure 7:
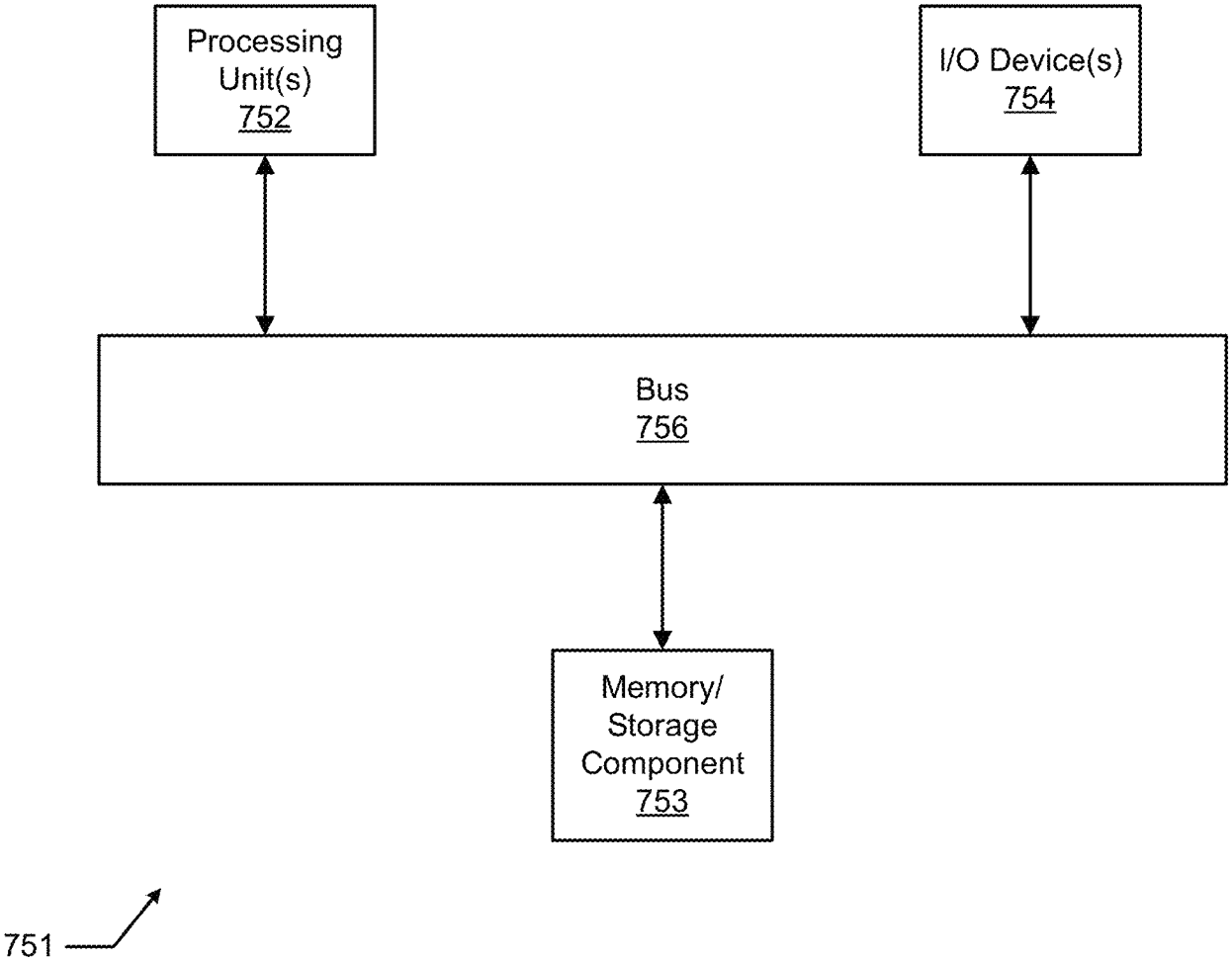
FIG. 7 shows a computer system in accordance with certain example embodiments.

In some cases, a range limit setting interface (e.g., range limit setting interface 325, range limit setting interface 225) can be a component of the system that is not physically manipulated by a user, as in FIGS. 2-4, but rather is manipulated in some other fashion (e.g., electronically, virtually). For example, a range limit setting interface can be embedded in hardware or software associated with a control module. For instance, FIGS. 6A and 6B show a system 600 in accordance with certain example embodiments. Specifically, FIG. 6A shows a system diagram of an electrical system 600 in accordance with certain example embodiments. FIG. 6B shows a system diagram of a control module 604 of the system 600 of FIG. 6A.

The system 600 of FIG. 6A includes a control device 610, at least one power source 695, at least one user 650, at least one electrical device 660, and a network manager 690. The control device 610 can include a control module 604, one or more optional sensors 667, and a selector circuit 620. The control module 604 in this case includes, as shown in FIG. 6B, a range limit setting interface 625, a control engine 607, a communication module 608, a timer 609, an energy metering module 611, a power module 613, a storage repository 630, a hardware processor 603, memory 622, a transceiver 636, an application interface 661, and an optional security module 663. The control device 610 of FIG. 6A is disposed between the electrical device 660 on one side and the users 650, the power sources 695, and the network manager 680 on the other side.

Each of the components of the system 600 are electrically and/or communicably coupled to at least one other component of the system 600 using wired technology (electrical conductors 602) and/or wireless technology (wireless links 605). For example, the power source 695 can be coupled to the control device 610 using one or more electrical conductors 102. As another example, the control device 610 can be coupled to a user system 655 of a user 650 using one or more wireless links 605. Each of these technologies are discussed below in more detail. The system 600 can include multiple control devices 610.

Each of the electrical devices 660 of the system 600 receive some amount of power, through one or more electrical cables 602, from the control device 610. The amount of power received by an electrical device 660 is based, at least in part, on the position of the selector circuit 620 and the upper and lower limits of the range of the selector circuit 620 based on the settings of the example range limit setting interface 625. As discussed above, an electrical device 660 can be a light fixture. In such a case, examples of a light fixture can include, but are not limited to, a troffer light, a can light, an emergency egress light, and a pendant light. Such a light fixture can use any of a number of lighting technologies, including but not limited to light-emitting diode (LED), incandescent, fluorescent, sodium vapor, and halogen.

Other examples of an electrical device 660 can include, but are not limited to, a sensing device (e.g., motion sensor, a temperature sensor, a smoke alarm), an inverter, a camera, a wall outlet, a photocell/timer, a power source (e.g., a LED driver, a ballast, a buck converter, a buck-boost converter), a controller (e.g., a pulse width modulator, a pulse amplitude modulator, a constant current reduction dimmer), a keypad, a touchscreen, a dimming switch, a thermostat, a shade controller, a universal serial bus charger, and a meter (e.g., water meter, gas meter, electric meter), and an illuminated exit sign.

The network manager 690 is a device or component that controls all or a portion (e.g., the control module 604 of the control device 610, the user 650, the power source 695) of the system 100. As shown in FIG. 6A, the network manager 690 can be coupled, using electrical conductors 602 and/or wireless links 605, to any of a number of users 650 (including one or more user systems 655), one or more power sources 695, and/or the control device 610. In some cases, while not shown in FIG. 6A, the network manager 690 can be coupled to (e.g., using electrical conductors 602, using wireless links 605) one or more of the electrical devices 660.

For example, the network manager 690 can send data and instructions to the control module 604 of the control device 610 as to new protocols 632 and/or stored data 634 (e.g., user preferences, threshold values). As another example, the network manager 690 can receive data (e.g., run time, current flow) associated with the operation of each electrical device 660 and/or the control device 610 to determine when maintenance should be performed. The network manager 690 can be substantially similar to the control module 604, as described below. Alternatively, the network manager 690 can include one or more of a number of features in addition to, or altered from, the features of the control module 604 described below.

The network manager 690 of FIG. 6A can communicate with (e.g., send instructions to, receive data from) the control device 610. If the system 600 includes multiple control devices 610, then the network manager 690 can communicate with some or all of those control devices 610. Instructions sent by the network manager 690 to the control device 610 can affect the operation of some or all of the control module 604. Communication between the control device 610, the network manager 690, the electrical devices 660, the power sources 695, and the users 650 (including any user systems 655) in the system 600 can include the transfer (sending and/or receiving) of power, control, communication and/or data using the electrical conductors 602 and/or the wireless links 605.

Such control and data can include instructions, status reports, notifications, and/or any other type of information. Specific examples of the power, data, and/or control sent between the control device 610, the network manager 690, the electrical devices 660, the power sources 695, and the users 650 (including any user systems 655) can include, but are not limited to, delivery of power, a light level, a light fade rate, a demand response, occupancy of an area, detection of daylight, a security override, a temperature, a measurement of power, a measurement or calculation of power factor, operational status, a mode of operation, a dimming curve, a color and/or correlated color temperature (CCT), a manual action, manufacturing information, performance information, warranty information, air quality measurements, upgrade of firmware, update of software, position of a shade, and a device identifier.

Each power source 695 generates and/or delivers, directly or indirectly, electrical power that is used by the electrical devices 660 in the system 600. Each power source 695 of FIG. 6A is coupled to the control device 610 using one or more electrical conductors 102 and/or one or more wireless links 606. A power source 695 can generate, directly or indirectly, power in the form of alternating current (AC) or direct current (DC) power. A power source 695 can also generate power at any of a number of appropriate amounts. Examples of voltages generated by a power source 695 can include 120 VAC, 240 VAC, 277 VAC, 24 VDC, 48 VDC, 380 VDC, and 480 VAC. If the LV energy is AC power, the frequency can be 50 Hz, 60 Hz, or some other frequency. Examples of a power source 695 (or portion thereof) can include, but are not limited to, a battery, a photovoltaic (PV) solar panel, a wind turbine, a power capacitor, an energy storage device, a power transformer, an inverter, a converter, a diode bridge, an inductor, a fuel cell, a generator, and a circuit panel.

If the power source 695 includes an energy storage device, the energy storage device can use one or more of any type of storage technology, including but not limited to a battery, a flywheel, an ultracapacitor, and a supercapacitor. If the energy storage device includes a battery, the battery technology can vary, including but not limited to lithium ion, lead/acid, solid state, graphite anode, titanium dioxide, nickel cadmium, nickel metal hydride, nickel iron, and lithium polymer.

A user 650 may be any person that interacts with electrical devices. Examples of a user 650 can include, but are not limited to, an employee, a supervisor, a visitor, an engineer, an electrician, an instrumentation and controls technician, a mechanic, an operator, a consultant, a systems commissioner, a janitor, a vendor, a manager, a contractor, and a manufacturer's representative. A user 650 can include one or more user systems 655, which can include a user interface (e.g., a button), an optional display (e.g., a GUI) and/or an optional controller, such as the controller 604 of the control module 604 of the control device 610 described below. Examples of a user system 655 can include, but are not limited to, a remote control, a hand-held transmitter, a personal computer (PC), a laptop, and a mobile phone.

A user system 355 can also include software (e.g., an app, a program) that allows a user 650 to communicate with and/or adjust one or more range limit settings for the control device 610. For example, the software on the user system 655 can allow a user 650 to communicate directly with the range limit setting interface 625 of the control module 604 of the control device 610 to adjust the upper and/or lower limit of the selector circuit 620 of the control device 610. In addition, or in the alternative, such software can be included with the network manager 680.

The signals sent between the user system 655 to the control device 610 can be addressable, so that only a particular user system 655 and/or control device 610 respond to a signal, whether sent through an electrical conductor 602 or a wireless link 605, while the rest of the user systems 655 and/or control devices 610 in the system 600 ignore the signal. In some cases, a user 650 (including a user system 655) can additionally communicate with the power sources 695, the network manager 690, and/or one or more of the electrical devices 660 using electrical conductors 602 and/or wireless links 605.

The electrical conductors 602 can include one or more conductors made of one or more electrically conductive materials (e.g., copper, aluminum). The size (e.g., gauge) of the electrical conductors 602 are sufficient to carry power distributed by the power source 695 to one or more of the other components of the system 600. Each electrical conductor 602 can be coated with an insulator made of any suitable material (e.g., rubber, plastic) to keep the electrical conductor electrically isolated from any electrical conductors 602. An electrical conductor 602 can transmit power signals, control signals, data signals, and/or communication signals.

When one or more electrical conductors 602 are used for non-power signals, those electrical conductors 602 can be part of a cable that is plenum rated. For example, one or more of the electrical conductors 602 can be used in drop ceilings without conduit or cable trays. Multiple electrical conductors 602 can be part of a type of cable, including but not limited to a LV cable, an Ethernet cable, and a RS485 cable. The wireless links 605 can be part of a network using one or more of a number of wireless technologies (e.g., Wi-Fi, Bluetooth, Bluetooth Low Energy, Zigbee, 6LoPan).

The control device 610 can be placed in any of a number of environments. In such a case, the housing 612 of the control device 610 can be configured to comply with applicable standards for any of a number of environments. For example, the control device 610 can be rated as a Division 1 or a Division 2 enclosure under NEC standards. Similarly, any of the sensors 667 or other devices communicably coupled to the control device 610 can be configured to comply with applicable standards for any of a number of environments. For example, a sensor 667 can be rated as a Division 1 or a Division 2 enclosure under NEC standards.

The housing 612 of the control device 610 can be used to house one or more components of the control device 610, including one or more components of the control module 604. For example, as shown in FIGS. 6A and 6B, the control module 604 (which in this case includes the control engine 607, the communication module 608, the timer 609, the energy metering module 611, the power module 613, the storage repository 630, the hardware processor 603, the memory 622, the transceiver 636, the application interface 661, and the optional security module 663), one or more optional sensors 667, and the selector circuit 620 can be disposed in the cavity 601 formed by the housing 612. In alternative embodiments, any one or more of these or other components of the control device 610 can be disposed on the housing 612 and/or remotely from the housing 612.

The selector circuit 620 is substantially the same as the selector circuits discussed above with respect to FIGS. 1-4. The one or more optional sensors 667 of the control device 610 can be any type of sensing device that measure one or more parameters. Examples of types of sensors 667 can include, but are not limited to, a camera, a motion sensor, a vibration sensor, an accelerometer, a passive infrared sensor, a photocell, and a resistance temperature detector. A parameter that can be measured by a sensor 667 can include, but is not limited to, a face, a fingerprint, a voice, movement, and a gesture, words. Examples of a sensor 667 can include, but are not limited to, a digital scanner (as for a face, a retina, a fingerprint), a microphone (as for recognizing a voice or a phrase), and an image capture device (as for recognizing a motion or series of motions).

A sensor 667 can be located within the housing 612 of the control device 610, disposed on the housing 612 of the control device 610, or located outside the housing 612 of the control device 610. A sensor 667 can include one or more components (e.g., hardware processor, memory, control engine) that are also included in the control module 604 described below. In some cases, a sensor 667 and the control module 604 can share one or more components between them. Also, a sensor 667 can include any software (e.g., facial recognition software, voice recognition software) necessary to perform the function of the sensor 667.

The storage repository 630 of the control module 604 of the control device 610 can be a persistent storage device (or set of devices) that stores software and data used to assist the control module 604 in communicating with the network manager 690, a user 650 (including a user system 655), the power source 695, and the electrical devices 660 within the system 600. In one or more example embodiments, the storage repository 630 stores one or more protocols 632, algorithms 639, and stored data 634. The protocols 632 can include any processes or logic steps that are implemented by the control engine 607 based on certain conditions at a point in time.

The protocols 632 can include any of a number of communication protocols that are used to send and/or receive data between the control module 604, the network manager 690, a user 650 (including a user system 655), the power source 695, and the electrical devices 660. One or more of the protocols 632 can be a time-synchronized protocol for communication. Examples of such time-synchronized protocols can include, but are not limited to, a highway addressable remote transducer (HART) protocol, a wirelessHART protocol, and an International Society of Automation (ISA) 100 protocol.

The algorithms 639 can be any models, formulas, and/or other similar operational implementations that the control engine 607 of the control module 604 uses. An algorithm 639 can at times be used in conjunction with a protocol 632. For example, an algorithm 639 and/or protocol 632 can be used by a control engine 607 to adjust, based on communication from a user 650 (or user system 655) and using the range limit setting interface 625, a setting for an upper limit and/or a lower limit for the selector circuit 620. Another example of a protocol 632 and/or an algorithm 639, working alone or in conjunction with each other, can be used by the control engine 607 to identify and interpret a parameter (e.g., a face, a voice) measured by a sensor 667 so that the control engine 607 can set an upper and/or lower limit using the range limit setting interface 625.

Stored data 634 can be any data associated with the system 600 (including the control device 610, a user 650 (including a user system 655), the power source 695, the electrical devices 660, and/or any components thereof), any measurements taken by the sensors 667, measurements taken by the energy metering module 611, time measured by the timer 609, threshold values, results of previously run or calculated algorithms 639, updates to the protocols 632, user preferences, and/or any other suitable data. Such data can be any type of data, including but not limited to historical data, current data, and forecast data. The stored data 634 can be associated with some measurement of time derived, for example, from the timer 609.

Examples of a storage repository 630 can include, but are not limited to, a database (or a number of databases), a file system, a hard drive, flash memory, some other form of solid state data storage, or any suitable combination thereof. The storage repository 630 can be located on multiple physical machines, each storing all or a portion of the communication protocols 632, the algorithms 639, and/or the stored data 634 according to some example embodiments. Each storage unit or device can be physically located in the same or in a different geographic location.

The storage repository 630 can be operatively connected to the control engine 607. In one or more example embodiments, the control engine 607 includes functionality to communicate with the network manager 690, the user 650, the power source 695, and the electrical devices 660 in the system 600. More specifically, the control engine 607 sends information to and/or receives information from the storage repository 630 in order to communicate with the network manager 690, a user 650 (including a user system 655), the power source 695, and the electrical devices 660. As discussed below, the storage repository 630 can also be operatively connected to the communication module 608 in certain example embodiments.

In certain example embodiments, the control engine 607 of the control module 604 controls the operation of one or more components (e.g., the communication module 608, the timer 609, the transceiver 636) of the control module 604. For example, the control engine 607 can activate the communication module 608 when the communication module 608 is in "sleep" mode and when the communication module 608 is needed to send data received from another component (e.g., a sensor 667, the user 150) in the system 100. As another example, the control engine 607 can acquire the current time using the timer 609. The timer 609 can enable the control module 604 to control the control device 610 (including any components thereof, such as the range limit setting interface 625) even when the control module 604 has no communication with the network manager 690.

As yet another example, the control engine 607 can instruct a sensor 667 to measure a parameter (e.g., a retina, a voice, words) associated with a user 650. The control engine 607 can then use an algorithm 639 and/or protocol 632 to identify and interpret a parameter (e.g., a face, a voice) measured by a sensor 667 so that the control engine 607 can set an upper and/or lower limit using the range limit setting interface 625. As still another example, the control engine 607 can then use an algorithm 639 and/or protocol 632 to adjust, based on communication from a user 650 (or user system 655) and using the range limit setting interface 625, a setting for an upper limit and/or a lower limit for the selector circuit 620.

As some specific examples of how the control engine 607 can be used to change an upper and/or lower limit of a range of values for the selector circuit 620, the control engine 607 can receive instructions to set an upper and/or lower limit from a user system 655, for example through an app. As another example, the control engine 607, using one or more sensors 667 and in conjunction with the optional security module 663, can recognize a face, retina, fingerprint, and/or other body part of a user 650, thereby allowing that user 650, either manually or electronically, to set an upper and/or lower limit.

As yet another example, the control engine 607, using one or more sensors 667, can recognize a voice command of a user 650 (either specifically identified as the user 650 for added security or words that can be spoken by anyone) to set an upper and/or lower limit. As still another example, the control engine 607, using one or more sensors 667, can recognize a gesture or series of gestures (e.g., holding a number of fingers, thumbs up, thumbs down) made by a user to set an upper and/or lower limit.

In some cases, the control engine 607 use one or more sensors 667 (e.g., a speaker, a microphone) to interact with a user 650 (including in some cases a user system 655) to request clarification, verify instructions received from a user 650 or user system 655. In some cases, when the control engine 607 communicates with a user system 655 in such a way, sensors 667 may not be necessary or used for such communication to transpire.

In certain example embodiments, the control engine 607 can include an interface that enables the control engine 607 to communicate with one or more components (e.g., a sensor 667, the selector circuit 620) of the control device 610. For example, if a sensor 667 of the control device 610 operates under IEC Standard 62386, then the sensor 667 can have a serial communication interface that will transfer data (e.g., stored data 634) measured by the sensors 667. In such a case, the control engine 607 can also include a serial interface to enable communication with the sensor 667 within the control device 610. Such an interface can operate in conjunction with, or independently of, the protocols 632 used to communicate between the control module 604 and the network manager 690, a user 650 (including a user system 655), the power source 695, and the electrical devices 660.

The control engine 607 (or other components of the control module 604) can also include one or more hardware components and/or software elements to perform its functions. Such components can include, but are not limited to, a universal asynchronous receiver/transmitter (UART), a serial peripheral interface (SPI), a direct-attached capacity (DAC) storage device, an analog-to-digital converter, an inter-integrated circuit ($I^2C$), and a pulse width modulator (PWM).

The communication module 608 of the control module 604 determines and implements a communication protocol (e.g., from the protocols 632 of the storage repository 630) that is used when the control engine 607 communicates with (e.g., sends signals to, receives signals from) the network manager 690, a user 650 (including a user system 655), the power source 695, and the electrical devices 660. In some cases, the communication module 608 accesses the stored data 634 to determine which protocol 632 is used to communicate with the sensor 667 associated with the stored data 634. In addition, the communication module 608 can interpret the protocol 632 of a communication received by the control module 604 so that the control engine 607 can interpret the communication.

The communication module 608 can send and receive data between the control module 604, the network manager 690, a user 650 (including a user system 655), the power source 695, and the electrical devices 660. The communication module 608 can send and/or receive data in a given format that follows a particular protocol 632. The control engine 607 can interpret the data packet received from the communication module 608 using the protocol 632 information stored in the storage repository 630. The control engine 607 can also facilitate the data transfer between one or more sensors 667, the network manager 690, a user 650 (including a user system 655), the power source 695, and the electrical devices 660 by converting the data into a format understood by the communication module 608.

The communication module 608 can send data (e.g., protocols 632, algorithms 639, stored data 634, operational information, alarms) directly to and/or retrieve data directly from the storage repository 630. Alternatively, the control engine 607 can facilitate the transfer of data between the communication module 608 and the storage repository 630. The communication module 608 can also provide encryption to data that is sent by the control module 604 and decryption to data that is received by the control module 604. The communication module 608 can also provide one or more of a number of other services with respect to data sent from and received by the control module 604. Such services can include, but are not limited to, data packet routing information and procedures to follow in the event of data interruption.

The timer 609 of the control module 604 can track clock time, intervals of time, an amount of time, and/or any other measure of time. The timer 609 can also count the number of occurrences of an event, whether with or without respect to time. Alternatively, the control engine 607 can perform the counting function. The timer 609 is able to track multiple time measurements concurrently. The timer 609 can track time periods based on an instruction received from the control engine 607, based on an instruction programmed in the software for the control module 604, based on some other condition or from some other component, or from any combination thereof.

The timer 609 can be configured to track time when there is no power delivered to the control module 604 (e.g., the power module 613 malfunctions) using, for example, a super capacitor or a battery backup. In such a case, when there is a resumption of power delivery to the control module 604, the timer 609 can communicate any aspect of time to the control module 604. In such a case, the timer 609 can include one or more of a number of components (e.g., a super capacitor, an integrated circuit) to perform these functions.

The energy metering module 611 of the control module 604 measures one or more components of power (e.g., current, voltage, resistance, VARs, watts) at one or more points (e.g., output of the selector circuit 620) associated with the control device 610. The energy metering module 611 can include any of a number of measuring devices and related devices, including but not limited to a voltmeter, an ammeter, a power meter, an ohmmeter, a current transformer, a potential transformer, and electrical wiring. The energy metering module 611 can measure a component of power continuously, periodically, based on the occurrence of an event, based on a command received from the control engine 607, and/or based on some other factor. In some cases, the energy metering module 611 can be a type of sensor 667.

The power module 613 of the control module 604 provides power to one or more other components (e.g., timer 609, control engine 607) of the control module 604. The power module 613 can include one or more of a number of single or multiple discrete components (e.g., transistor, diode, resistor), and/or a microprocessor. The power module 613 may include a printed circuit board, upon which the microprocessor and/or one or more discrete components are positioned. In some cases, the power module 613 can include one or more components that allow the power module 613 to measure one or more elements of power (e.g., voltage, current) that is delivered to and/or sent from the power module 613. Alternatively, the control module 604 can include a power metering module (not shown) to measure one or more elements of power that flows into, out of, and/or within the control module 604.

The power module 613 can include one or more components (e.g., a transformer, a diode bridge, an inverter, a converter) that receives power (for example, through an electrical cable) from a source external to the control device 610 and generates power of a type (e.g., AC, DC) and level (e.g., 12V, 24V, 120V) that can be used by the other components of the control module 604. The power module 613 can use a closed control loop to maintain a preconfigured voltage or current with a tight tolerance at the output. The power module 613 can also protect the rest of the electronics (e.g., hardware processor 603, transceiver 636) in the control device 610 from surges generated in the line. In addition, or in the alternative, the power module 613 can be a source of power in itself to provide signals to the other components of the control module 604. For example, the power module 613 can be a battery. As another example, the power module 613 can be a localized photovoltaic power system.

In certain example embodiments, the power module 613 of the control module 604 can also provide power and/or control signals, directly or indirectly, to one or more of the sensors 667. In such a case, the control engine 607 can direct the power generated by the power module 613 to the sensors 667 and/or one or more power supplies 140 of the control device 610. In this way, power can be conserved by sending power to the sensors 667 of the control device 610 when those devices need power, as determined by the control engine 607.

The hardware processor 603 of the control module 604 executes software, algorithms, and firmware in accordance with one or more example embodiments. Specifically, the hardware processor 603 can execute software on the control engine 607 or any other portion of the control module 604, as well as software used by the network manager 690, a user 650 (including a user system 655), the power source 695, and the electrical devices 660. The hardware processor 603 can be an integrated circuit, a central processing unit, a multi-core processing chip, SoC, a multi-chip module including multiple multi-core processing chips, or other hardware processor in one or more example embodiments. The hardware processor 603 is known by other names, including but not limited to a computer processor, a microprocessor, and a multi-core processor.

In one or more example embodiments, the hardware processor 603 executes software instructions stored in memory 622. The memory 622 includes one or more cache memories, main memory, and/or any other suitable type of memory. The memory 622 can include volatile and/or non-volatile memory. The memory 622 is discretely located within the control module 604 relative to the hardware processor 603 according to some example embodiments. In certain configurations, the memory 622 can be integrated with the hardware processor 603.

In certain example embodiments, the control module 604 does not include a hardware processor 603. In such a case, the control module 604 can include, as an example, one or more field programmable gate arrays (FPGA) and/or one or more relays. Using FPGAs and/or other similar devices known in the art allows the control module 604 (or portions thereof) to be programmable and function according to certain logic rules and thresholds without the use of a hardware processor. Alternatively, FPGAs and/or similar devices can be used in conjunction with one or more hardware processors 120.

The transceiver 636 of the control module 604 can send and/or receive control and/or communication signals. Specifically, the transceiver 636 can be used to transfer data between the control module 604 and a user 650 (including a user system 655), the network manager 690, and/or the sensors 667. The transceiver 636 can use wired and/or wireless technology. The transceiver 636 can be configured in such a way that the control and/or communication signals sent and/or received by the transceiver 636 can be received and/or sent by another transceiver that is part of the network manager 690, a user 650 (including a user system 655), the power source 695, and the electrical devices 660. The transceiver 636 can use any of a number of signal types, including but not limited to radio signals.

When the transceiver 636 uses wireless technology, any type of wireless technology can be used by the transceiver 636 in sending and receiving signals. Such wireless technology can include, but is not limited to, Wi-Fi, visible light communication, cellular networking, and Bluetooth. The transceiver 636 can use one or more of any number of suitable communication protocols (e.g., ISA100, HART) when sending and/or receiving signals. Such communication protocols can be stored in the communication protocols 632 of the storage repository 630. Further, any transceiver information for the network manager 690, a user 650 (including a user system 655), the power source 695, and the electrical devices 660 can be part of the stored data 634 (or similar areas) of the storage repository 630.

The users 650 (including the user systems 655), the network manager 690, power sources 695, the sensors 667, the selector circuit 620, and/or the electrical devices 660 can interact with the control module 604 using the application interface 661 in accordance with one or more example embodiments. Specifically, the application interface 661 of the control module 604 receives data (e.g., measurements of parameters, communications, instructions, updates to firmware) from and sends data (e.g., information, communications, instructions) to the users 650 (including the user systems 655), the network manager 690, power sources 695, the sensors 667, the selector circuit 620, and/or the electrical devices 660.

The users 650 (including the user systems 655), the network manager 690, power sources 695, the sensors 667, the selector circuit 620, and/or the electrical devices 660 can include an interface to receive data from and send data to the control module 604 in certain example embodiments. Examples of such an interface can include, but are not limited to, a graphical user interface, a touchscreen, an application programming interface, a keyboard, a monitor, a mouse, a web service, a data protocol adapter, some other hardware and/or software, or any suitable combination thereof.

Optionally, in one or more example embodiments, the security module 663 secures interactions between the control module 604, the network manager 690, a user 650 (including a user system 655), the power source 695, and/or the electrical devices 660. More specifically, the security module 663 authenticates communication from software based on security keys verifying the identity of the source of the communication. For example, user software may be associated with a security key enabling the software of the network manager 690 to interact with the control module 604 and/or the sensors 667. Further, the security module 663 can restrict receipt of information, requests for information, and/or access to information in some example embodiments. The security module 663 can also validate a communication or signal received from another component (e.g., an electrical device 660).

FIG. 2 illustrates one embodiment of a computing device 751 that implements one or more of the various techniques described herein, and which is representative, in whole or in part, of the elements described herein pursuant to certain exemplary embodiments. For example, the control module 604 (including components such as the control engine 607, the transceiver 636, the hardware processor 603) of FIGS. 6A and 6B can be considered a computing device 751. Computing device 751 is one example of a computing device and is not intended to suggest any limitation as to scope of use or functionality of the computing device and/or its possible architectures. Neither should computing device 751 be interpreted as having any dependency or requirement relating to any one or combination of components illustrated in the example computing device 751.

Computing device 751 includes one or more processors or processing units 752, one or more memory/storage components 753, one or more input/output (I/O) devices 754, and a bus 756 that allows the various components and devices to communicate with one another. Bus 756 represents one or more of any of several types of bus structures, including a memory bus or memory controller, a peripheral bus, an accelerated graphics port, and a processor or local bus using any of a variety of bus architectures. Bus 756 includes wired and/or wireless networks.

Memory/storage component 753 represents one or more computer storage media. Memory/storage component 753 includes volatile media (such as random access memory (RAM)) and/or nonvolatile media (such as read only memory (ROM), flash memory, optical disks, magnetic disks, and so forth). Memory/storage component 753 includes fixed media (e.g., RAM, ROM, a fixed hard drive, etc.) as well as removable media (e.g., a Flash memory drive, a removable hard drive, an optical disk, and so forth).

One or more I/O devices 754 allow a customer, utility, or other user to enter commands and information to computing device 751, and also allow information to be presented to the customer, utility, or other user and/or other components or devices. Examples of input devices include, but are not limited to, a keyboard, a cursor control device (e.g., a mouse), a microphone, a touchscreen, and a scanner. Examples of output devices include, but are not limited to, a display device (e.g., a monitor or projector), speakers, outputs to a lighting network (e.g., DMX card), a printer, and a network card.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media. Computer readable media is any available non-transitory medium or non-transitory media that is accessible by a computing device. By way of example, and not limitation, computer readable media includes "computer storage media".

"Computer storage media" and "computer readable medium" include volatile and non-volatile, removable and non-removable media implemented in any method or technology for storage of information such as computer readable instructions, data structures, program modules, or other data. Computer storage media include, but are not limited to, computer recordable media such as RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which is used to store the desired information and which is accessible by a computer.

The computer device 751 is connected to a network (not shown) (e.g., a local area network (LAN), a wide area network (WAN) such as the Internet, cloud, or any other similar type of network) via a network interface connection (not shown) according to some exemplary embodiments. Those skilled in the art will appreciate that many different types of computer systems exist (e.g., desktop computer, a laptop computer, a personal media device, a mobile device, such as a cell phone or personal digital assistant, or any other computing system capable of executing computer readable instructions), and the aforementioned input and output means take other forms, now known or later developed, in other exemplary embodiments. Generally speaking, the computer system 751 includes at least the minimal processing, input, and/or output means necessary to practice one or more embodiments.

Further, those skilled in the art will appreciate that one or more elements of the aforementioned computer device 751 is located at a remote location and connected to the other elements over a network in certain exemplary embodiments. Further, one or more embodiments is implemented on a distributed system having one or more nodes, where each portion of the implementation (e.g., control engine 607) is located on a different node within the distributed system. In one or more embodiments, the node corresponds to a computer system. Alternatively, the node corresponds to a processor with associated physical memory in some exemplary embodiments. The node alternatively corresponds to a processor with shared memory and/or resources in some exemplary embodiments.

The systems and methods described herein allow for improved and simplified control of an electrical device. For instance, example range-adjustable wallbox controllers can be used to control a parameter (e.g., CCT, intensity) of light emitted by a light fixture without the need for a separate power source and by using simple, inexpensive components. Example embodiments also allow for user control of the upper and lower bounds of a range of selections for the parameter being controlled by the example range-adjustable wallbox controller. Example embodiments can operate on a 0-10V signal and allows for flexibility in terms of locating the range-adjustable wallbox controller within a given space as well as setting the limits of the range-adjustable wallbox controller. Example embodiments can be scalable, designed to support a range of multiple (e.g., 50) electrical devices in a volume of space. The upper and/or lower limits of example range-adjustable wallbox controllers can be adjusted manually and/or virtually.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A wallbox controller for controlling a parameter of an electrical device, the wallbox controller comprising:

a selector circuit that controls a value of the parameter within a range of values;

a user interface coupled to the selector circuit, wherein the user interface is configured to provide for manual adjustment of the value of the parameter within the range of values;

a faceplate through which the user interface is disposed;

a first dial limit coupled to the selector circuit, wherein the first dial sets an upper limit for the range of values, wherein the first dial is disposed adjacent to the faceplate and is adjustable without removing the faceplate; and a second dial coupled to the selector circuit, wherein the second dial sets a lower limit for the range of values, wherein the second dial is disposed adjacent to the faceplate and is adjustable without removing the faceplate.

2. The wallbox controller of claim 1, wherein the first dial comprises a variable resistor.

3. The wallbox controller of claim 1, wherein the first dial is accessible after a cover of the wallbox controller is removed.

4. The wallbox controller of claim 1, wherein the first dial is also controllable using software operating on a user system of a user.

5. The wallbox controller of claim 1, wherein the first dial is also controllable based on words spoken by a user.

6. The wallbox controller of claim 1, wherein the first dial is also controllable based on recognition of a body part of a user.

7. The wallbox controller of claim 1, wherein the first dial is also controllable based on at least one particular gesture of a user.

8. The wallbox controller of claim 1, wherein the first dial is configured substantially the same as the second dial.

9. The wallbox controller of claim 1, further comprising:

a current sinking circuit coupled to the selector circuit, wherein the current sinking circuit sends a signal to the electrical device, wherein the signal corresponds to the value of the parameter within the range of values.

10. The wallbox controller of claim 9, wherein the signal is between 0V and 10V.

11. The wallbox controller of claim 10, wherein the signal is initiated by a power supply of the electrical device.

12. The wallbox controller of claim 1, wherein the first dial is accessible when the wallbox controller is fully assembled and installed.

13. The wallbox controller of claim 1, wherein the electrical device comprises a light fixture.

14. The wallbox controller of claim 13, wherein the parameter is a correlated color temperature of light emitted by the light fixture.

15. The wallbox controller of claim 13, wherein the parameter is an intensity of light emitted by the light fixture.

16. The wallbox controller of claim 1, wherein the user interface comprises a slider.

17. The wallbox controller of claim 1, wherein the user interface comprises a dial.

* * * * *